US006343886B2

(12) United States Patent
Shochat

(10) Patent No.: US 6,343,886 B2
(45) Date of Patent: Feb. 5, 2002

(54) SEMISOLID SUBSTANCE CONTAINER WITH MOVABLE BOTTOM

(76) Inventor: Boris Shochat, 20/8 Katzenelson Str., Rishon-Lezion 75217 (IL)

( * ) Notice: Subject to any disclaimer, the term of this patent is extended or adjusted under 35 U.S.C. 154(b) by 0 days.

(21) Appl. No.: 09/771,968

(22) Filed: Jan. 30, 2001

(30) Foreign Application Priority Data

Feb. 14, 2000 (IL) ..... 134530

(51) Int. Cl.[7] ..... A45D 40/02
(52) U.S. Cl. ..... 401/87; 401/88
(58) Field of Search ..... 401/87, 88, 89, 401/95, 78

(56) References Cited

U.S. PATENT DOCUMENTS

| | | | | |
|---|---|---|---|---|
| 3,677,654 A | | 7/1972 | Davis | |
| 3,913,595 A | * | 10/1975 | Grisel | 401/78 |
| 4,108,558 A | | 8/1978 | Radice et al. | |
| 5,871,295 A | * | 2/1999 | Bouix | 401/88 |
| 5,893,672 A | | 4/1999 | Erickson | |

OTHER PUBLICATIONS

Patent Abstracts of Japan, for JP 08191717 A, Kanebo Ltd. Key Tranding Co Ltd. Takeuchi Kogyo KK., published Jul. 30, 1996.

Patent Abstracts of Japan, for JP 09056465 A, Takeuchi Kogyo KK., published Mar. 4, 1997.

Patent Abstracts of Japan, for JP 10000116 A, Takeuchi Kogyo KK., published Jan. 6, 1998.

Patent Abstracts of Japan, for JP 10005040, Rexam Cosmetic Packaging Inc., published Jan. 13, 1998.

Patent Abstracts of Japan, for JP 11113631 A, Sakamoto Teruya., published Apr. 27, 1999..

ESP Abstract, for JP 10337216, Takeuchi Kogyo KK., published Dec. 22, 1998.

* cited by examiner

*Primary Examiner*—David J. Walczak
(74) *Attorney, Agent, or Firm*—Browdy and Neimark

(57) ABSTRACT

A container for keeping and dispensing to the end a semi-solid substance such as lipstick or glue. The container comprises a substance holder with a radially protruding holder pin, an intermediate cylinder with an open end for exposing the substance and with an axially extending guiding slit, and an outer sleeve with an internal helical groove. The holder pin passes though the guiding slit and is received in the helical groove in such a way that a rotation of the outer sleeve causes the axial displacement of the substance holder. The holder has an axially movable bottom and is thereby capable of ejecting the substance from the holder to provide for its full use. The container has means for self-arresting the movable bottom against substantial back movement relative to the substance holder.

12 Claims, 3 Drawing Sheets

PRIOR ART

SEMISOLID SUBSTANCE CONTAINER WITH MOVABLE BOTTOM

FIELD OF THE INVENTION

The present invention relates to a dispensing container for semi-solid or pasty substances such as lipstick, glue, polish, etc, shaped as a stick, the container having a cup-like holder in which the stick of substance is fixed. The invention particularly refers to economical and wasteless-use designs of such a container.

BACKGROUND OF THE INVENTION

In conventional containers of the above type, an axially movable cup-like holder carrying a stick of substance is usually mounted in an intermediate cylinder fitted within an outer sleeve in a manner enabling the rotation of the cylinder and the sleeve relative to each other. The container has further a base portion integral with the intermediate cylinder and protruding from the outer sleeve, to be held by the user. To enable the axial movement of the holder with respect to the intermediate cylinder to expose and hide the stick of substance, the intermediate cylinder is formed with at least one axial slit, the outer sleeve has at least one helical groove formed in its internal surface and the holder is formed with at least one radially protruding pin passing through the slit in the intermediate cylinder and received in the helical grooves of the outer sleeve. The substance holder, the intermediate cylinder and the outer sleeve cooperate in such a manner that, when the intermediate cylinder with the base portion and the outer sleeve are rotated relative to each other in a predetermined direction, the holder advances axially towards the open end of the intermediate cylinder to expose the stick of substance for usage. When the relative rotation between the outer sleeve and the intermediate cylinder with the base is provided in the opposite direction, the substance holder is retracted back to hide the stick of substance for safe keeping.

During application, the stick of substance is expected to sustain axial and radial forces, and not to deform or break. This necessarily limits the usable free stick length to about 2–5 cm, depending on the stick's diameter, material, and mode of application. Furthermore, for the stick of substance not to fall out of the holder under these forces, its rear end is usually tightly inserted in the holder to about 1 1.5 cm of its length, which therefore cannot be used. Thus, a significant proportion of the substance is practically wasted for the user.

To solve the above problem, U.S. Pat. No. 5,893,672 suggests an extractor for recovering and dispensing the unusable portion of a pasty substance located in a holder of an original packaging. This device is a stand-alone dispenser comprising a casing, a cover, and a piston-like bottom, which has to be filled with the remains of the pasty material from the original packaging. The extractor has to fit quite precisely in the opening of the original packaging and, therefore, for different shapes of original packaging different extractors are required.

U.S. Pat. No. 3,677,654 discloses a lipstick dispenser which is based on the conventional design described above, but has a holder with an independently movable bottom and an outer cylinder with a groove at its internal surface, that has a conventional helical section and a non-conventional annular section adjacent to the open end of the container. The movable bottom is formed with a radially protruding pin that passes though the holder's axial slit and is received within the outer sleeve's helical groove, cooperating with them in the same manner as the holder's pins that are responsible for the axial movement of the holder. Thus, when the holder, together with the movable bottom, is driven to the extreme exposed position by the relative rotation of the outer sleeve with respect to the intermediate cylinder, the holder's pins enter the annular portion of the groove whilst the pin of the movable bottom is still engaged with the helical portion. In this state, a further rotation of the outer sleeve relative to the intermediate cylinder will cause the pin of the movable bottom to advance along the holder with the holder being kept still, and eject the remainder of the lipstick for ultimate use. The reverse rotation of the sleeve relative to the intermediate cylinder moves the bottom in the rearward direction of the container. During this movement the holder is supposed to suck the lipstick back so as to retract the entire holder-bottom assembly. However, to ensure the suction of the lipstick by the movable bottom, there should be provided an airtight connection between this bottom and the holder, and between the holder and the lipstick, which is hardly achievable. Therefore, chances are rather high that, on the way back, the bottom will detach from the lipstick material, which will then remain in unstable position before the next use.

It is the object of the present invention to provide a new dispensing container for semi-solid or pasty substances such as lipstick, glue, polish, etc, shaped as a stick, enabling the convenient and efficient usage of the substance substantially along the entire stick length thereof.

SUMMARY OF THE INVENTION

The present invention provides a container for keeping and dispensing a semisolid or pasty substance such as lipstick or glue, comprising a substance holder, an intermediate cylinder with a base, and an outer sleeve, which have a design and manner of interaction basically the same as in conventional dispensing containers, the container however having additional features enabling economical and wasteless-use of its substance. In particular, in the container of the present invention, the substance holder has a bottom movable relative thereto, the container being so designed as to enable the advancement of the bottom towards the container's open end and self-arresting the bottom against its back movement relative to the holder. This enables the bottom of the holder to be fixed in an advanced position relative to the holder, while the container may be further used in the normal way, without the user feeling any resistance to the usual manipulation, whereby to expose the substance stick for application and to conceal it after use, the substance holder is axially displaced by the rotation of the outer sleeve and the intermediate cylinder relative to each other.

In accordance with the present invention, the advancement of the bottom relative to the substance holder is preferably provided by a pushing element capable of applying to the bottom a central axial force directed from the base of the intermediate cylinder.

The self-arresting of the bottom in its advanced position is preferably provided by the interaction of either the movable bottom or the pushing element with the walls of the substance holder.

The container according to the present invention may have substance holders with a specific novel design of their bottom wall enabling the movement of this wall relative to the side walls of the substance holder. Alternatively, the substance holder 30 may have a conventional cup-like design with integral side and bottom walls and an additional movable bottom formed as a separate element inserted in the substance holder to cover its own integral bottom wall, prior to the fixation of the stick of substance therein.

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF PREFERRED EMBODIMENTS

Figure 1:
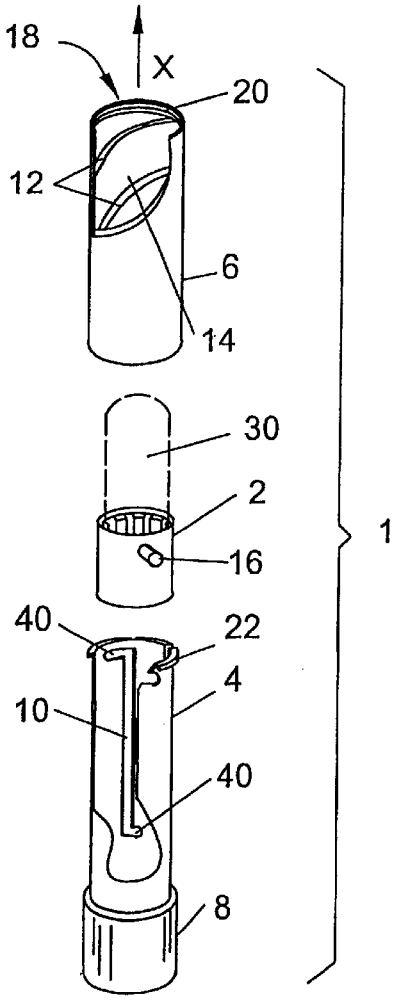
FIG. 1 is an exploded perspective view of the conventional retractable lipstick container.
Figure 2:
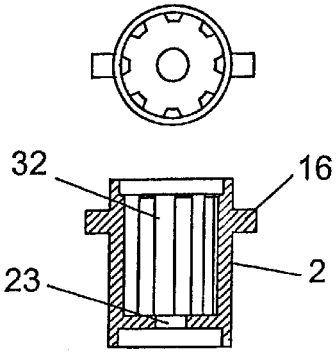
FIG. 2 PRIOR ART
FIG. 2 shows a cross-sectional and top views of a substance holder of the conventional lipstick container of FIG. 1.
Figure 4:
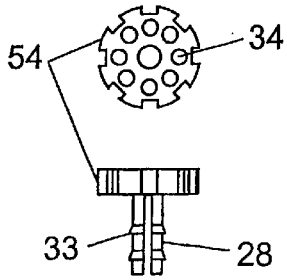
FIG. 4 is a cross-sectional and top view of a movable bottom, for use in the container of FIG. 3.

FIGS. 1 and 2 illustrate a conventional container 1 for keeping and dispensing a semisolid or pasty substance such as lipstick or glue and, particularly, they illustrate the components of the conventional container that are generally present in all embodiments of the present invention.

The conventional container has a longitudinal axis X and comprises a substance holder 2 axially movably received within an intermediate cylinder 4, and an outer sleeve rotatably mounted on the intermediate cylinder when the container is assembled. The intermediate cylinder has an integral base 8, which protrudes therefrom and from the outer sleeve when the container is assembled, and by which the user usually holds the container. The container also has a covering cap, (not shown) that normally mates in shape and circumference with the base of the intermediate cylinder. All parts are typically, but not exclusively, plastic castings.

The intermediate cylinder 4 is formed with a pair of axial slits 10, the outer sleeve 6 has a pair of helical grooves 12 formed on its internal surface 14 and the substance holder 2 has a pair of radially protruding pins 16 passing through the slits of the intermediate cylinder and received in the helical grooves of the outer sleeve when the container is assembled. The outer sleeve is formed, at the open end 18 of the container, with an annular recess 20, and the intermediate cylinder has a corresponding outwardly protruding annular lip 22 to be received therein so as to allow free mutual rotation of the outer sleeve 6 relative to the intermediate cylinder 4, while preventing their mutual axial displacement. The number of pins, slits and helical grooves may be different from two.

A stick of semi-solid substance 30 is fixed in the substance holder 2 by pressing or molding. As shown in FIG. 2, the holder has typically longitudinal ribs 32 on its internal surface, which enhance the gripping force on the stick of semi-solid substance, and strengthen the area where the radial pins 16 are formed. To let the air out in the process of pressing or molding the substance in the substance holder, the holder's bottom wall is normally formed with a central opening 23.

When the user holds the base 8 of the intermediate cylinder 4 with his/her one hand and the outer sleeve 6 with the other hand, and rotates one of them relative to the other, the pins 16 of the substance holder cooperate with the slits 10 of the intermediate cylinder and the helical grooves 12 of the outer sleeve, causing the movement of the substance holder 2 with the stick 30 therein in the axial direction. Thereby, the stick is protruded to a position suitable for application or, alternatively, is retracted neatly for safekeeping. The slit 10 of the intermediate cylinder 4 usually terminates in one or two transverse elbows 40 to lock the substance holder 2 in extreme positions.

FIGS. 3 to 13 illustrate containers according to different embodiments of the present invention, where in addition to the above conventional components, which are appropriately modified, the containers have a movable bottom provided in the substance holder, a pushing element for its advancement to a predetermined height relative to the substance holder and means for arresting the movable bottom against its back movement relative to the substance holder. In these embodiments, either the pushing element or the movable bottom are capable of interacting with the substance holder so as to self-arrest the movable bottom against its back movement with respect thereto. In these embodiments, the outer cylinder is of the conventional design, whilst the holder and, in some of the embodiments, the slit and the base of the intermediate cylinder have been modified.

Figure 3:
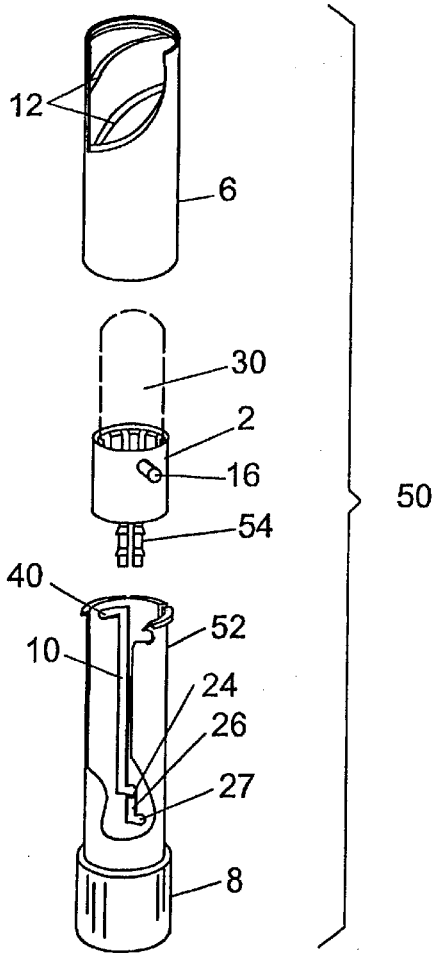
FIG. 3 is an exploded perspective view of a lipstick container according to one embodiment of the present invention.

FIG. 3 illustrates a container 50 according to one embodiment of the present invention. The container 50 comprises a conventional substance holder 2, a conventional sleeve 6, a slightly modified intermediate cylinder 52 and a novel movable bottom 54 shown specifically in FIG. 4. The modification of the intermediate cylinder of container 50 is expressed in forming in its guiding slit an extension 26 and a breakable bridge 24. The movable bottom is formed integral with a split shaft 28 constituting its pushing element. The shaft has arresting elements in the form of at least two tiers of outwardly protruding steps 33 chamfered at the side of the bottom and having a diameter slightly larger than that of opening 23 of the substance holder. The distance between the protruding steps and the movable bottom, as well as the length of the extension 26 in the intermediate cylinder's guiding slit 10 correspond to the desired advancement of the movable bottom relative to the substance holder. Additionally, the movable bottom 54 is formed with holes or recesses 34 at its side facing the pasty substance for increasing the gripping force between the movable bottom and the substance.

Figure 5:
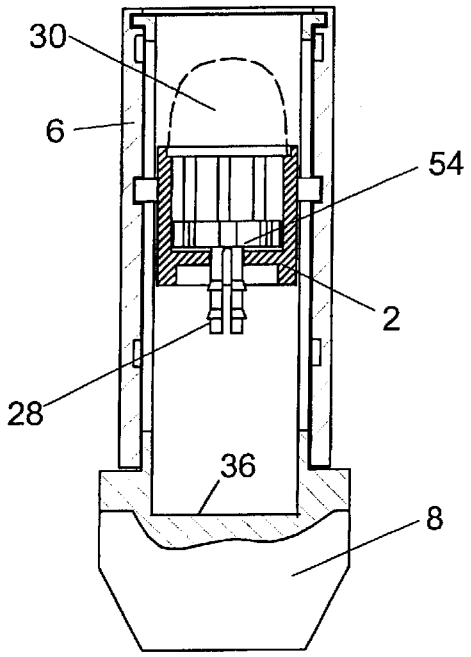
FIG. 5 is a cross-sectional view of the lipstick container shown in FIG. 3.

Prior to fixing a stick of substance 30 in the substance holder 2, the movable bottom 54 is slidingly inserted into the substance holder in a piston-like manner, by squeezing the shaft 28 within the limits of elastic deformation and pushing it into the central opening 23 of the holder to the entire length of the shaft, as illustrated in FIG. 5.

In use, when the stick of substance is worn down near to the edge of the holder of the container 50, the user has to retract the holder into the intermediate cylinder 52 by rotation of the outer sleeve 6, and to continue turning the sleeve in the same direction, with an extra effort. Due to the extra effort, the bridge 24 will break and let the pin 16 enter the slit extension 26 and let the substance holder move towards the base of the intermediate cylinder until the shaft 28 reaches the internal surface 36 of the base. Further turning of the outer sleeve in the same direction will cause the shaft to abut upon the internal surface of the base and produce an axial force advancing the movable bottom with respect to the holder and eject the portion of the stick held in the substance holder by a length equal to the distance between the bottom 54 and the first tier of arresting steps 33. Upon the engagement of the arresting steps 33 with the opening 23 by their chamfered sides, the split shaft is first squeezed and advances to let the steps pass through the opening, and then expands again to arrest the movable bottom and prevent its retreat. The click from the expansion can be easily felt or heard by the user, thereby giving him control over the ejection. Then, the stick with the holder can be exposed for further application and retreated for keeping, in the usual manner. This operation may be repeated for the second tier of arresting steps, and for any subsequent tier. Recesses 34 formed on the movable bottom secure the stability of the stick of substance in its advanced positions, where the gripping force between the substance and the holder is reduced.

Figure 6:
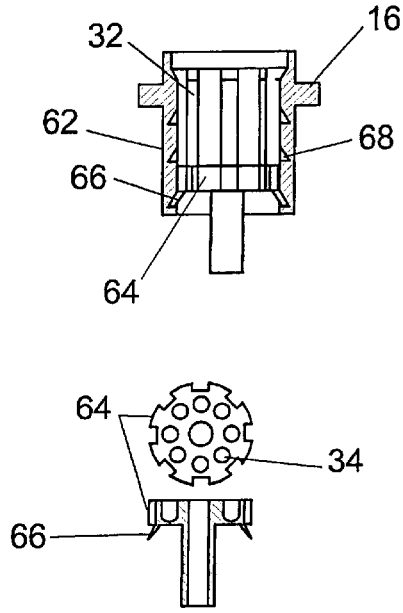
FIG. 6 is a cross-sectional and top views of a movable bottom with nibs and its holder.

The container described above and illustrated in FIGS. 3, 4 and 5 may be modified by arranging its arresting elements at the circumference of the movable bottom and at the internal surface of the substance holder. As shown in FIG. 6, the movable bottom 64 is fitted on its circumference with elastic nibs 66 designed to engage a tier of teeth 68 or other arresting elements formed on the internal surface of the holder 62. Before fitting the stick of semi-solid substance into the holder, the movable bottom must be inserted into the holder from the base side and arrested in the nearest tier of arresting elements.

Figure 7:
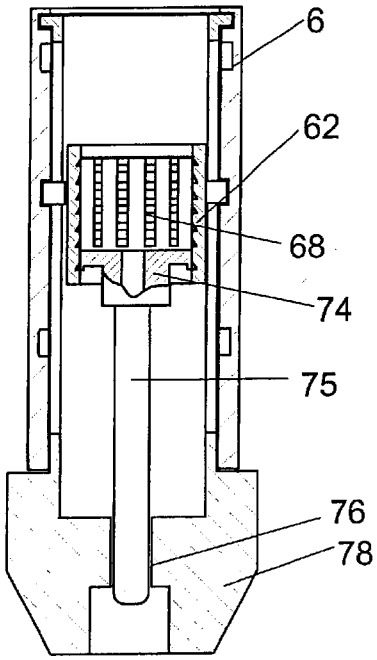
FIG. 7 is a cross-sectional view of a lipstick container in accordance with another embodiment of the present invention.

FIG. 7 illustrates another embodiment of the container of the present invention, where the pushing element is integral with the movable bottom 74 and is formed as an elongated shaft 75 piercing the base 78 of the intermediate cylinder through a dedicated opening 76 in the base. The arresting elements in this embodiment are in the form of elastic nibs on the movable bottom and tiers of teeth on the internal surface of the substance holder, as shown in FIG. 6. The intermediate cylinder's guiding slit has an extension similar to the extension 26 in FIG. 3, which however terminates in a locking elbow 27 shown in dotted line in FIG. 3. To enable the pushing of the movable bottom by means of the shaft, the holder must be retracted into the intermediate cylinder by rotation of the outer sleeve 6 in the same manner as in the containers shown in FIGS. 3 and 5, until the pin 16 enters the slit extension 26 and the elbow 27, thereby locking the substance holder in its lowest position. With the substance holder being thereby locked, the shaft 75 protrudes through the opening 76 and may be pushed by any appropriate means to produce the axial force for advancing the movable bottom 74 with respect to the holder 62 and to eject some of the remaining length of the stick.

Figure 8:
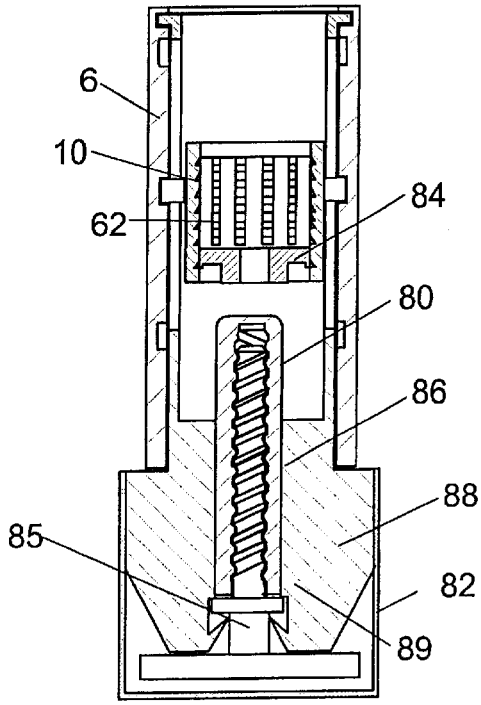
FIG. 8 is a cross-sectional view of a lipstick container in accordance with a further embodiment of the present invention.

FIG. 8 illustrates a still further embodiment of the container of the present invention, where arresting elements of the movable bottom 84 and the internal surface of the substance holder 62 are similar to those in FIG. 6. The guiding slit 10 formed in the intermediate cylinder may have a locking elbow 27 as shown in dotted line in FIG. 3, or a locking elbow 40 as shown in FIG. 1. The pushing element of the container illustrated in FIG. 8 is a telescope device located in the base 88 of the intermediate cylinder and consisting of a rotatable knob 89 with threaded shaft 85 engaged with a threaded piston 80 slidably fitted in a well 86 formed in the base 88. The well 86 and the piston 80 therein are preferably of non-circular cross-section preventing their relative rotation. Preferably, the telescope device is protected by a tight-fit cap 82.

In operation, to provide the advancement of the movable bottom 84 towards the open end of the container, the substance holder 62 should be locked in its retracted position in the manner as described above with respect to the container shown in FIG. 7 or in FIG. 1; the cap 82, if any, should be removed and the knob 89 should be rotated, thereby pushing the sliding piston 80 towards the movable bottom 84 until its abutment against the movable bottom and applying the axial force to advance the movable bottom with respect to the substance holder by actuating the telescope device. Thereby, a deeper holder may be used to accommodate a longer stick of semi-solid substance without increasing the length of the container.

Figure 9:
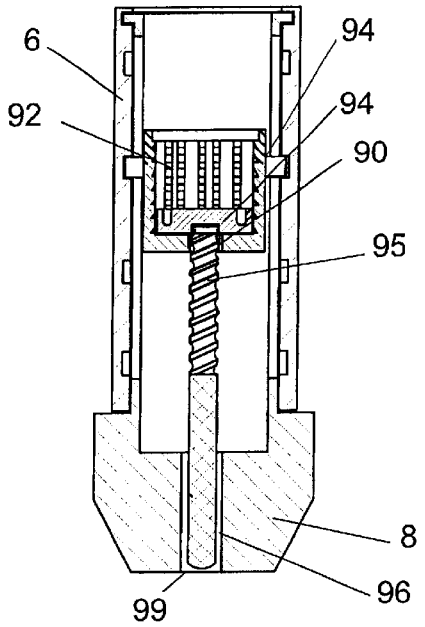
FIG. 9 is a cross-sectional view of a lipstick container in accordance with still further embodiment of the present invention.
Figure 10:
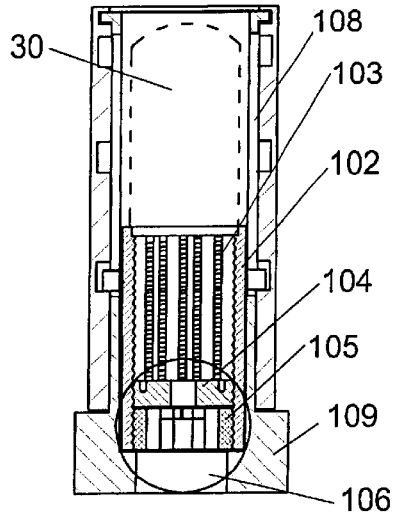
FIG. 10 is a cross-sectional view of a lipstick container in accordance with still further embodiment of the present invention.
Figure 11:
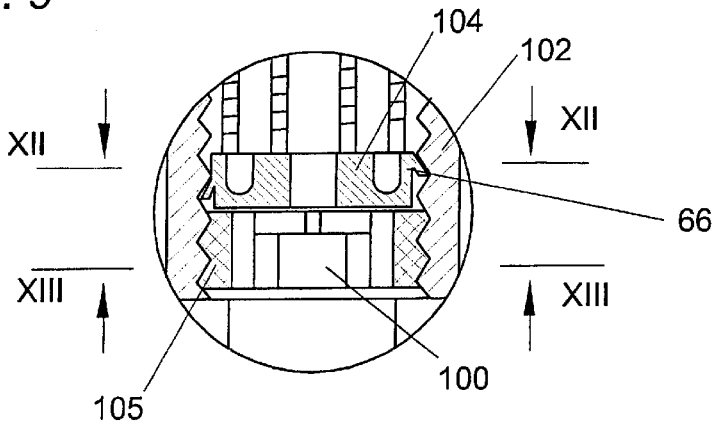
FIG. 11 is an enlarged view of the details in FIG. 10.
Figure 12:
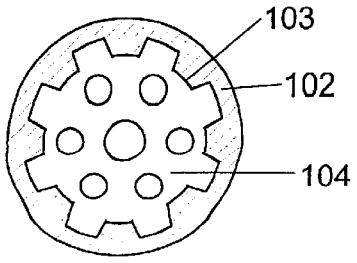
FIGS. 12 and 13 are cross-sectional views of the container shown in FIG. 10 along lines XII and XIII in FIG. 11.
Figure 13:
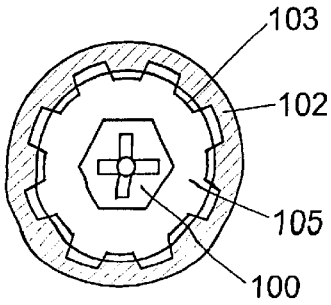

A still further embodiment of a container of the invention is shown in FIG. 9, which container differs from that illustrated in FIG. 8 in that the pushing element here is a threaded shaft 95 engaged with a threaded opening 90 in the substance holder 92, the shaft having an extension 99 passing through a dedicated opening 96 in the base 8 of the intermediate cylinder, to be rotated manually to produce the axial force on the movable bottom 94 and advance it with respect to the substance holder.

FIGS. 10 through 13 illustrate a still further embodiment of a container of the present invention, comprising: a substance holder 102 with an internal surface having longitudinal ribs 103 and a thread formed atop the internal surface of the ribs; the pushing element in the form of a grub-screw 105 engaged in the thread atop the ribs; and a movable bottom 104 with a set of elastic nibs 66 that are formed at the circumference of the movable bottom in such a manner as to engage with the teeth formed by the intersection of the thread and the ribs of the internal surface of the substance holder. The grub-screw is formed with a recess 100 on its side opposite to the movable bottom, the recess being of such configuration as to engage positively with and transmit rotation from a driving element which may be a handy implement such as hexagonal prismatic pencil, cosmetic nail file, small penknife, and a screwdriver. The intermediate cylinder 108 is formed with a guiding slit having the locking elbow as in FIG. 1, and a base 109 having an opening 106 wide enough to let through the driving element (not shown).

In operation, the advancement of the movable bottom is provided by locking the substance holder 102 in retracted position, and rotating the grub-screw 105 by the driving element, thereby moving the grub-screw off the base 109 of the intermediate cylinder and producing the axial force on the movable bottom. The arresting of the movable bottom against its back movement relative to the substance holder is provided by the engagement of the elastic nibs 66 with the threaded teeth atop the ribs 103. This embodiment allows for the full use of the container's length, and may be employed for designs of long economic containers.

A plurality of designs of a container according to the present invention different from those described above and shown in the drawings, are possible within the scope of the claims.

What is claimed is:

1. A container for keeping and dispensing a semisolid or pasty substance such as lipstick or glue, the container having a longitudinal axis, comprising a substance holder with at least one radially protruding holder pin, an intermediate cylinder with a base and an open end for exposing said substance, and with at least one axially extending guiding slit, and an outer sleeve with at least one internal helical groove, said at least one holder pin passing slidably through said at least one guiding slit and being received in said at least one helical groove in such a way that the rotation of said outer sleeve relative to said intermediate cylinder causes the axial displacement of said substance holder, said holder further having a bottom movable relative to the substance holder by an advancement means and thereby capable of ejecting said substance from said holder, characterized in that said container has means for self-arresting the movable bottom against substantial back movement relative to said substance holder after said movable bottom has been advanced.

2. A container according to claim 1, wherein said advancement means is a pushing element capable of applying to said bottom an axial force directed from the base of the intermediate cylinder.

3. A container according to claim 2, wherein said pushing element protrudes from the movable bottom towards the base and is actuable upon lowering the substance holder and upon abutting of the pushing element against the base of the intermediate cylinder, whereby said axial force is applied to the movable bottom.

4. A container according to claim 2, wherein said pushing element is actuable in the region of the base of the intermediate cylinder to apply said axial force to the movable bottom while the substance holder stays in fixed position relative to the base.

5. A container according to claim 4, wherein said pushing element is an elongated shaft passing through a dedicated opening in the base of said intermediate cylinder and capable of being pushed or rotated towards the substance holder to advance said movable bottom.

6. A container according to claim 4, wherein said pushing element is a telescope device formed in the base of the intermediate cylinder, capable of extending towards the substance holder and abutting against said movable bottom.

7. A container according to claim 4, wherein said pushing element is a grub-screw placed in the substance holder beneath the movable bottom and engaged with a corresponding thread formed in an internal surface of the substance holder and capable of being rotated by a driving element actuated in the region of the base in such a way as to advance the grub-screw and, thereby, the movable bottom relative to the substance holder.

8. A container according to claim 2, wherein said pushing element is integral with said movable bottom.

9. A container according to claim 2, wherein said pushing element is in permanent contact with said movable bottom.

10. A container according to claim 8 or 9, said substance holder further having an integral bottom wall pierced by said pushing element, wherein the self-arresting means include interacting arresting elements formed at the pushing element and in the bottom wall.

11. A container according to claim 10, wherein a base end of said at least one guiding slit of the intermediate cylinder is formed with an extension and a breakable bridge separating said extension from the guiding slit and tentatively preventing the motion of said at least one holder pin into said extension, thereby tentatively preventing the lowering of the substance holder towards the base and the abutment of the pushing element against the base of the intermediate cylinder.

12. A container according to claim 1, wherein the self-arresting means include interacting arresting elements formed at the movable bottom and at an internal surface of the substance holder.

* * * * *